US005888914A

United States Patent [19]

Katz

[11] Patent Number: 5,888,914

[45] Date of Patent: Mar. 30, 1999

[54] SYNTHETIC FIBER FABRICS WITH ENHANCED HYDROPHILICITY AND COMFORT

[75] Inventor: Manfred Katz, Wilmington, Del.

[73] Assignee: Optimer, Inc., Wilmington, Del.

[21] Appl. No.: 755,893

[22] Filed: Dec. 2, 1996

[51] Int. Cl.[6] ..... D03D 15/08

[52] U.S. Cl. ..... 442/184; 442/191; 442/306; 442/310; 57/256; 57/244; 139/420 A; 66/171; 66/202

[58] Field of Search ..... 57/256; 139/420 A, 139/420 B; 66/170, 171, 202; 442/182, 184, 191, 306, 310, 328, 334

[56] References Cited

U.S. PATENT DOCUMENTS

| | | | |
|---|---|---|---|
| 3,587,220 | 6/1971 | Eggleston | 57/140 |
| 3,881,525 | 5/1975 | Kocay et al. | 139/420 R |
| 4,196,574 | 4/1980 | Rhash | 57/226 |
| 4,342,565 | 8/1982 | Teague et al. | 8/532 |
| 4,343,334 | 8/1982 | Schulze et al. | 139/420 R |
| 4,675,226 | 6/1987 | Ott | 428/102 |
| 4,736,467 | 4/1988 | Schwarze et al. | 2/114 |
| 4,748,705 | 6/1988 | Johnson et al. | 8/115.7 |
| 4,808,188 | 2/1989 | Ledford et al. | 8/115.68 |
| 4,991,387 | 2/1991 | Tashiro et al. | 57/256 |
| 5,027,438 | 7/1991 | Schwarze et al. | 2/114 |
| 5,075,902 | 12/1991 | McReynolds et al. | 2/238 |
| 5,467,512 | 11/1995 | Weingarten et al. | 28/100 |
| 5,477,595 | 12/1995 | Weingarten et al. | 28/100 |

*Primary Examiner*—Christopher Raimund
*Attorney, Agent, or Firm*—Woodcock Washburn Kurtz Mackiewicz & Norris, LLP

[57] ABSTRACT

Yarns consisting essentially of about 85 to 90 weight % hydrophobic fiber and about 10 to 15 weight % hydrophilic fiber can be made into fabrics that exhibit a combination of properties that make them strongly preferred by wearers, as compared even to fabrics made from yarns containing only 5% more, or 5% less, of the hydrophilic fiber. More particularly, these novel yarns yield fabrics capable of quickly absorbing perspiration from a wearer's skin and yet capable of quickly releasing that moisture, resulting in surprising levels of wearer comfort and wearer preference.

40 Claims, 4 Drawing Sheets

SYNTHETIC FIBER FABRICS WITH ENHANCED HYDROPHILICITY AND COMFORT

FIELD OF THE INVENTION

This invention relates to yarns formed by combining hydrophobic fibers with an amount of hydrophilic fibers sufficient to yield fabrics capable of quickly absorbing perspiration from a wearer's skin and yet also capable of quickly releasing that moisture, resulting in surprising levels of wearer comfort and wearer preference.

BACKGROUND OF THE INVENTION

Due to the inherent, hydrophobic nature of many synthetic fibers, such as polyester, polypropylene, and others, fabrics formed entirely from these synthetic fibers exhibit poor moisture absorption and release properties. Many methods have been tried to enhance the hydrophilicity of polyester materials in order to achieve improved comfort in apparel fabrics. For example, hydrophilic co-monomers have been incorporated into polyethyleneterephthalate to give more hydrophilic fibers, but at the expense of fiber properties. Numerous hydrophilic polymeric finishes and chemicals have been applied to hydrophobic fabrics but have not met with widespread acceptance. They often affect the fabric hand, but a greater problem is their lack of permanence; the hydrophilic properties are frequently lessened or lost on laundering of the garments.

More permanent treatments, such as graft polymerization of hydrophilic vinyl monomers onto hydrophobic substrates, and the treatment of polyester materials with reducing agents such as lithium borohydride or various oxidizing agents, although fairly effective, add significant cost to the finished material. Both acid and base treatments of polyester materials have been described, but the improvement in hydrophilicity is offset by a significant loss in fabric strength due to hydrolysis of the ester linkages.

A technique that has been used successfully to improve the comfort of polyester in apparel fabrics is to blend polyester staple with 35 to 50% of a hydrophilic fiber, such as cotton or wool. Although woven or knit fabrics made from spun yarns of polyester with 35 to 50% cotton are very comfortable when dry, they become uncomfortable when wet due to the high moisture absorption of cotton. This is especially undesirable in cold weather when absorbed perspiration due to physical exertion can cause hypothermia while resting.

Therefore, there exists a need for a fabric that will provide increased comfort to the wearer. More specifically, there is a need for a fabric which is capable of quickly absorbing perspiration from the skin of the wearer, but which will also quickly release the moisture so that the moisture content in the fabric remains low.

SUMMARY OF THE INVENTION

It has now been found, surprisingly, that fabrics made from yarns consisting essentially of about 85 to 90 weight % hydrophobic fiber and about 10 to 15 weight % hydrophilic fiber exhibit a combination of properties that make them strongly preferred by wearers, as compared even to fabrics made from yarns containing only 5% more, or 5% less, of the hydrophilic fiber. In user-wear tests, these fabrics were judged to have a high degree of comfort under conditions of skin wetness and thermal sensation. Accordingly, this invention relates to yarns consisting essentially of about 85 to 90 weight % hydrophobic fiber and about 10 to 15 weight % hydrophilic fiber, to fabrics made from such yarns, and to garments made from such fabrics.

DETAILED DESCRIPTION OF THE INVENTION

Figure 1:
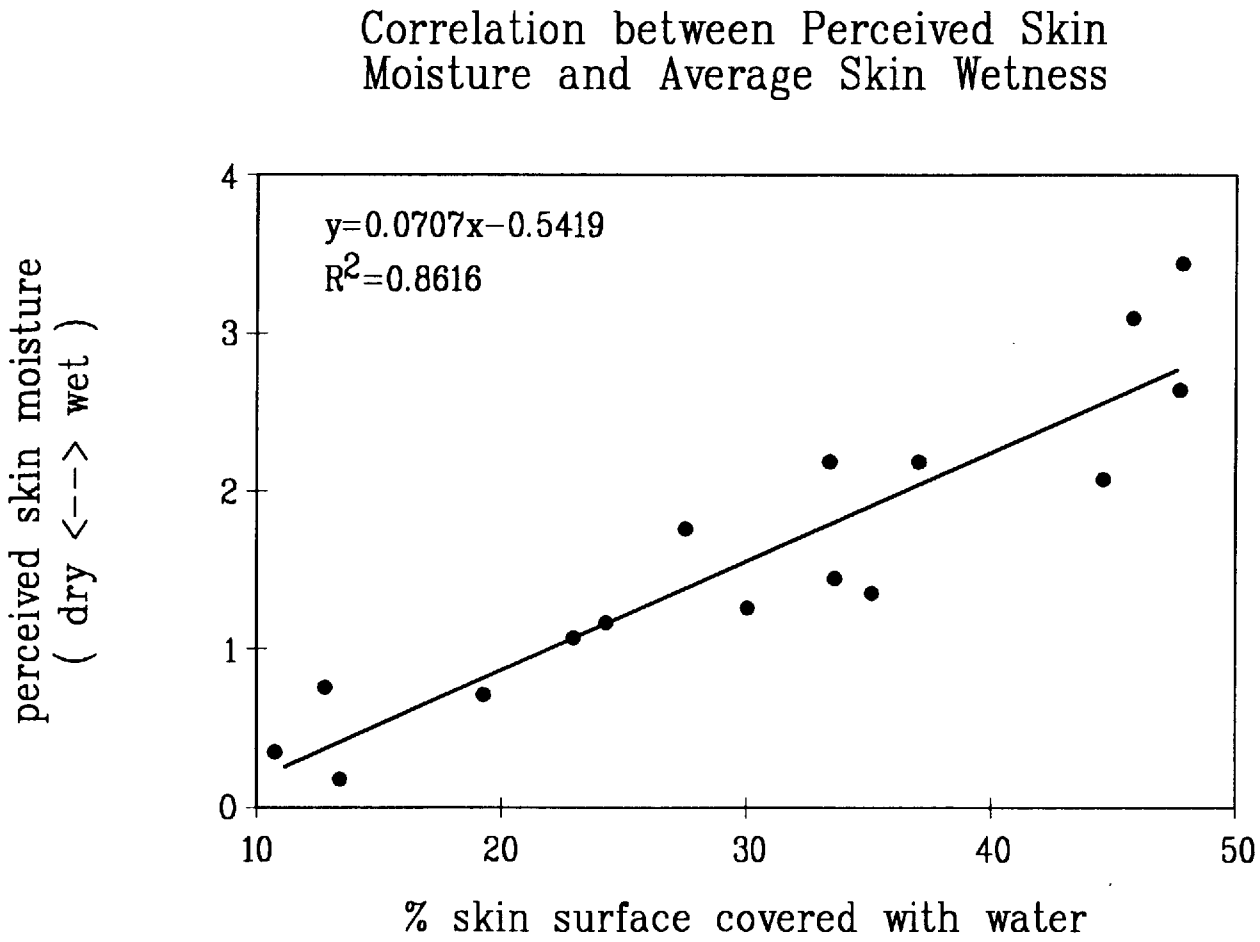
FIG. 1 is a graph showing the correlation between perceived skin moisture and average skin wetness.

The yarns of this invention comprise a combination of hydrophilic and hydrophobic fibers. As is well known in the art, hydrophilic fibers are fibers that exhibit a relatively high water absorption. For the purpose of this invention, hydrophilic fibers are those which will absorb at least about 15 percent of their weight in water. Examples of hydrophilic fibers include cellulosic fibers such as cotton and rayon, as well as worsted, wool and polyvinylalcohol. Conversely, hydrophobic fibers are fibers that are relatively non-water absorptive and moisture insensitive. For the purpose of this invention, hydrophobic fibers are those fibers that will absorb from zero to 10 percent of their weight in water. Examples of hydrophobic fibers include nylon, polypropylene, polyesters such as polyethyleneterephthalate and nylon, and polyacrylonitrile.

For the purpose of this invention, the amount of water that fibers will absorb may be measured by weighing the dried fibers, exposing the fibers to conditions of 100% relative humidity and room temperature, for a period of twelve hours, and weighing the fibers to determine the weight % of water absorbed.

The yarns of this invention may include more than one type of hydrophilic fiber and/or more than one type of hydrophobic fiber. Preferred embodiments of this invention are yarns consisting essentially of blends of polyester and cotton.

As illustrated in the examples below, it has surprisingly been found that fabrics made from fibers of blends of about 10 and about 15 weight percent hydrophilic fiber and about 85 to about 90 weight percent hydrophobic fiber are preferred by users in wear tests. This finding is surprising because these fabrics are preferred, by a significant amount, over fabrics made from blends containing only 5% more, or 5% less, of the hydrophilic fiber.

The hydrophilic and hydrophobic fibers may be combined by any number of means known in the art. For example, the fibers may be blended as staple and then spun into yarn from which a fabric is knitted or woven. Alternatively, the yarn may be prepared by wrapping the blended staple fibers around a continuous hydrophobic core to form a sheath. The term "yarn" is utilized herein to encompass any assemblage of the hydrophilic and hydrophobic fibers, in a continuous strand, that can be made into a textile material. In other words, the term "yarn" as used herein encompasses spun yarns and sheathed filaments, as well as other possible embodiments. The methods for preparing such yarns are well known in the art and need not be repeated here. See, for example, the discussions in T.Ishida, *An Introduction to Textile Technology*, published by Osaka Senken Ltd, Osaka Japan (1991); or J. H. Marvin, *Textile Processing*, Vol. 1, South Carolina State Dept. of Education (1973), the disclosures of which are herein incorporated by reference.

The yarns of hydrophilic and hydrophobic fibers can be made into a textile material by conventional means such as weaving and knitting. Non-woven fabrics may also be made from the blended fibers. Other fibers may be incorporated into the fabric to obtain desired properties. For example, the fabric may contain about 5 to about 10% of a continuous elastomeric filament (such as Lycra® elastomer fiber, DuPont Company, Wilmington, Del.), incorporated into the fabric to provide stretch and recovery properties. Due to the enhanced hydrophilic nature, low moisture retention, and rapid drying of the fabrics of this invention, they should be particularly preferred for making active wear garments and thermal underwear.

The fabrics may be dyed and finished in a conventional manner as described in references such as T.Ishida, *An Introduction to Textile Technology*, and J. H. Marvin, *Textile Processing*, cited above.

The following tests were carried out to evaluate the fabrics of this invention.

EXAMPLE

The objective of this study was to quantify the water transport and absorption properties of a series of fabrics, differing only in polyester-cotton content, and how those properties affected the thermoregulatory performance and comfort perception of the wearer during intermittent rest-exercise activities.

Test garments were single layer, long underwear tops and bottoms made from 26/1 c.c. ring spun yarns with 17.5 turns per inch of each of the following fibers:

100% polyester

Blend of 95% polyester/5% cotton

Blend of 90% polyester/10% cotton

Blend of 85% polyester/15% cotton

Blend of 80% polyester/20% cotton. (The polyester utilized was polyethylene terephthalate, specifically, Comfortrel® polyester, available from Wellman Corporation.) These yarns were converted into single knit jersey fabrics with 5% Lycra® elastomer fiber (trademark of DuPont Company, Wilmington, DE) on a circular knitting machine.

The fabric made from 100% polyester with 5% Lycra® fiber was subjected to a commercial "Akwatek" treatment, as disclosed in U.S. Pat. No. 4,808,188, i.e., it was treated with lithium borohydride, in a pressure-dyeing process. The fabrics made from the four polyester/cotton blends plus Lycra® fiber, as well as an additional length of fabric of 100% polyester and 5% Lycra® fiber, were put through the same pressure-dyeing treatment, but without the lithium borohydride.

The dyed fabrics were slit and finished by passing them through a wash bath and then a bath containing a wetting agent and a softener, before moving onto a tenter frame where they were stretched to the desired basis weight (10.5 ounces/linear yard of a 60 inch wide fabric), dried and heat set. One square meter piece of each of the fabrics, and an identical, commercial fabric of 100% cotton and 5% Lycra® fiber were washed once with detergent (Tide) and three additional times without detergent, to eliminate softener and wetting agents. Vertical wicking and horizontal wetting tests were carried out on the washed fabrics.

For the vertical wicking test, one-inch wide strips of the fabric were suspended above a beaker of de-ionized water. The beaker was raised slowly until the fabric strips were one inch below the surface of the water. The height of the water wicking up the fabric was measured at five minute intervals, for twenty minutes. The results, presented in Table 1, show that the wicking capability of the fabric increased with cotton content.

TABLE 1

Vertical Wicking

| Fabric | Height of Water (cm.) after 15 minutes |
|---|---|
| 100% Polyester | 3.5 |
| 95/5 Polyester/Cotton | 3.7 |
| "Akwatek"-treated 100% Polyester | 5.4 |
| 90/10 Polyester/Cotton | 7 |
| 85/15 Polyester/Cotton | 8 |
| 80/20 Polyester/Cotton | 8.6 |
| 100% Cotton | 14 |

The horizontal wetting test simulates the effect of a fabric laying flat against the skin. The fabrics of 100% cotton, the 10, 15 and 20% cotton blends, and the "Akwatek"—treated polyester, were all completely wetted after 20 seconds or less. The 100 polyester and 5% cotton blend required at least 40 seconds for complete wetting.

Six human subjects were placed in an environment of 76° F. (22° C.) for about ten minutes while they changed into a test garment, which garment had been laundered as described above for the test fabric samples. (Each subject tested a garment made from each of the test fabrics; thus, this test was repeated six times.) After they had changed into the test garments, the subjects entered the test chamber. The environmental conditions in the chamber were still air (uniform air speed of 0.05 meter per second), a 70° F. (21° C.) temperature, and a relative humidity of 65%. In the test chamber, the subjects were fitted with the following instrumentation: thermocouples, humidity sensors, and a heart rate monitor.

Eight copper constantan thermocouples, for measuring skin temperatures were applied: one each on the forehead, hand, upper arm, lower arm, thigh, calf, chest, and back. Another equal number of thermocouples, for measuring the clothing's outside surface temperature, were applied. The average skin and outside clothing temperatures were calculated from the local temperatures as area-weighted means.

Miniature humidity sensors were placed on the skin under the clothing to measure skin humidity levels and to calculate skin wetness (w). These were placed on the chest, back, upper arm, lower arm, thigh, and calf. The humidity sensors consisted of a capacitance-type relative humidity sensor and a thermocouple to measure the sensor's temperature (Ti). Skin wetness is a specific measure of skin moisture and is defined as the fraction of skin's surface that must be covered with water to account for the observed evaporation rate. (Gagge, A. P., "A New Physiological Variable Associated with Sensible and Insensible Perspiration," *American Journal of Physiology*, Vol. 20, (2) pp. 277–287(1987).) It is expressed as a fraction from 0 to 1, or as a percentage. The local skin wetness (wi) can be calculated from the local skin temperature (Tski), relative humidity (Rhi) measured next to the skin under clothing and the ambient temperature (Ta) and relative humidity (Rha) as follows:

$$wi=[Rhi*Ps(Ti)-Rha*PS(Ta)]/[Pa(Tski-Rha*Ps(Ta)],$$

where Ps(Ti), Ps(Ta) and Ps(Tski) are the saturation vapor pressure of water at temperatures Ti, Ta and Tski, respectively. The average skin wetness under clothing is the area weighted mean of the local wetness values.

Photo-optical devices were applied to the ear lobe to measure the subjects' heart rate. Oxygen consumption was measured at the appropriate periods with a mask and an open flow measuring system.

Fitting the subjects with the test instrumentation took approximately 15 minutes. The experiment then began, with the subject sitting on a webbed chair of a horizontal cycle ergometer. The ergometer also had resistance for arm activities of cross-country skiing. After 15 minutes of sitting quietly (rest period), the subject started cycling at a load and RPM to give a metabolic rate of 4.5 met, and continued exercising for 15 minutes. (One "met" is the activity or metabolic rate of a resting person; thus, at 5 met, a person is producing energy at a rate of 5 times his resting rate.) The rest-exercise cycle was repeated three times, with the third exercise period followed by 50 minutes of post-exercise recovery.

The garments were weighed before and after the experimental sessions to determine the amount of perspiration remaining in the garment. More specifically, the garments were weighed before the subjects wore them and, after the exercise session, were allowed to dry, while being worn under ambient conditions for 50 minutes before being weighed. The amount of perspiration retained in each of the garments is presented below in Table 2.

TABLE 2

Moisture Retention

| Fabric | grams retained moisture (Mean) |
|---|---|
| "Akwatek"-treated polyester | 2.0 |
| 80/5 Polyester/Cotton | 1.8 |
| 90/10 Polyester/Cotton | 2.2 |
| 85/15 Polyester/Cotton | 4.5 |
| 80/20 Polyester/Cotton | 5.0 |
| 100% Cotton | 12.0 |

It is believed that these differences would have been greatly magnified had the garments been weighed immediately after the last exercise, rather than after the 50-minute, post-exercise recovery period.

Periodically, the subjects perceptions and judgments about the environment were gathered through a questionnaire. The subjects marked a ballot to correspond to their whole body thermal sensation, comfort level, perceived skin moisture, perceived environmental humidity, perceived effort of exertion, acceptability of the thermal environment, and hedonic and texture ratings of the clothing fabric at that moment. For the acceptability question, the subjects were instructed that, for the environment to be unacceptable, it must be sufficiently so to cause a behavioral response, such as changing the thermostat, altering clothing, turning on a fan, opening a window, complaining, or leaving the space. The questionnaire was filled out by the subjects at 0, 15, 20, 30, 35, 45, 50, 60, 65, 75, 80, 90, 95, 105, 120 and 140 minutes from the start of data collection. The test subject perceptions reported in FIGS. 1–4 were determined from this questionnaire.

Figure 2:
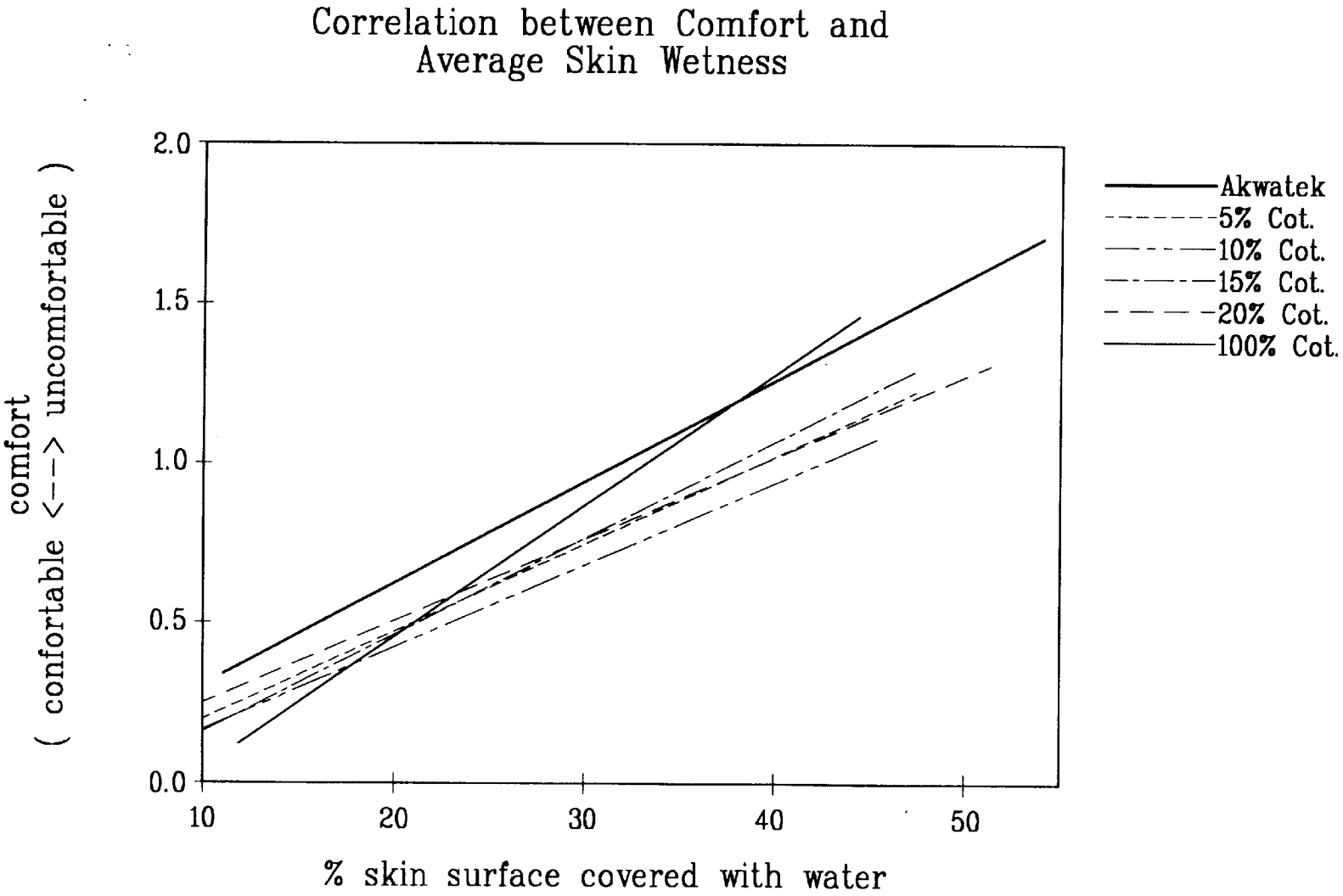
FIG. 2 is a graph showing the correlation between comfort and skin wetness for a series of test fabrics.

On analyzing data for average skin moisture and the subjects responses regarding comfort, it was determined that perceived skin moisture is highly correlated with measured skin wetness. As shown in FIG. 1, an increase in skin moisture or wetness leads to increasing discomfort. FIG. 2 shows the differences in comfort for the six different garments as a function of skin wetness. Under dry conditions, the 100% cotton garment is the most comfortable, but, as the body perspires, it rapidly becomes the least comfortable, even more uncomfortable than the "Akwatek"—treated polyester. The regression lines for the polyester/cotton blends are almost parallel, and fabrics of those blends are more comfortable than cotton as the body begins to perspire. Although differences among the four blends are small, the 10% cotton blend appears to be preferred.

Figure 3:
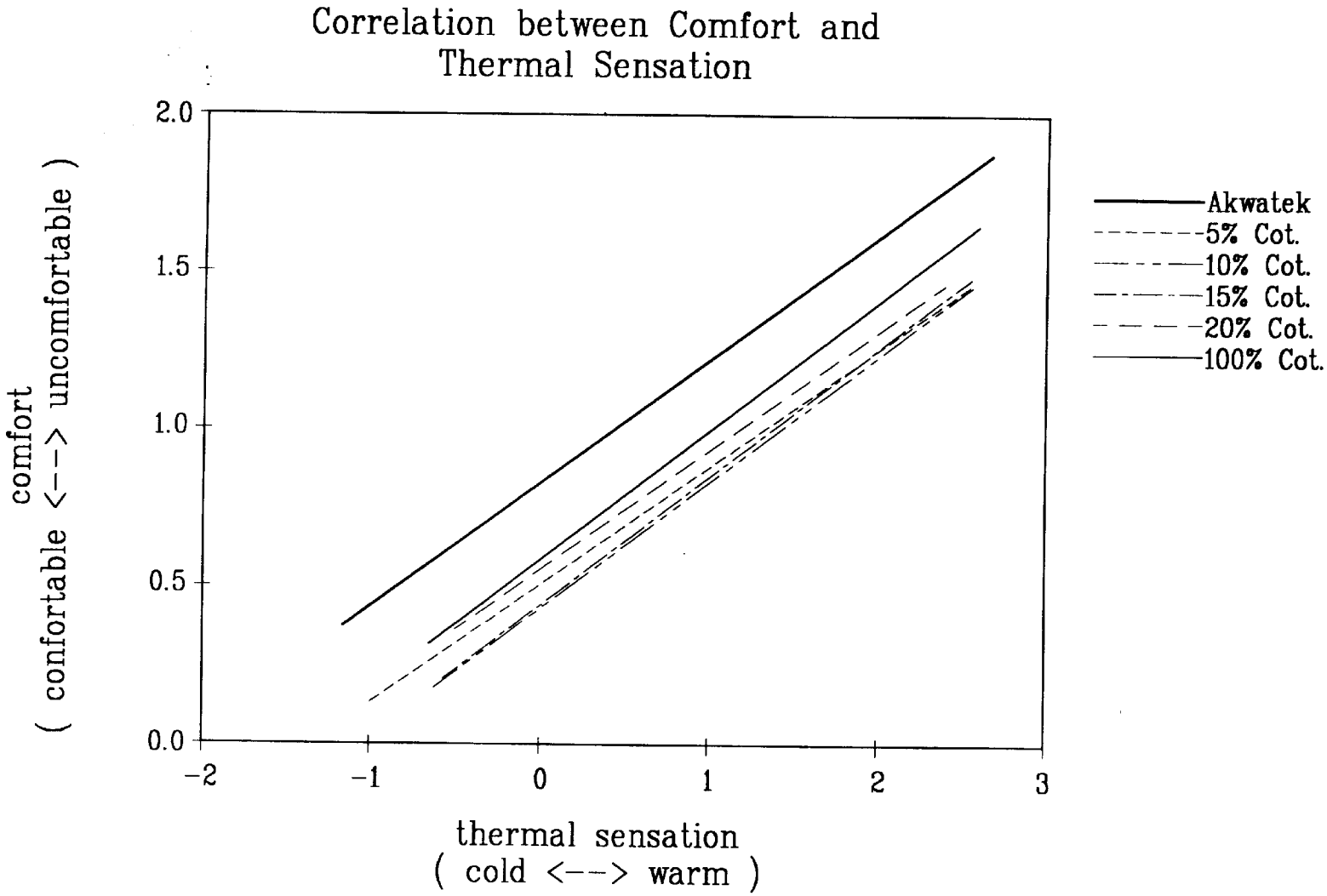
FIG. 3 is a graph showing the correlation between comfort and thermal sensation.

FIG. 3 presents a correlation between comfort and thermal sensation. A close linear relationship exists between comfort and thermal sensation ($p<0.001$). As a person's body temperature rises (increasing thermal sensation), there is an increase in discomfort. The four polyester/cotton blends were consistently more comfortable than 100% cotton and "Akwatek"—treated polyester over the whole range of thermal sensations. Of the four blends, the 10 and 15% cotton blends were very close and were perceived as being more comfortable than the 5 and 20% cotton blends.

Figure 4:
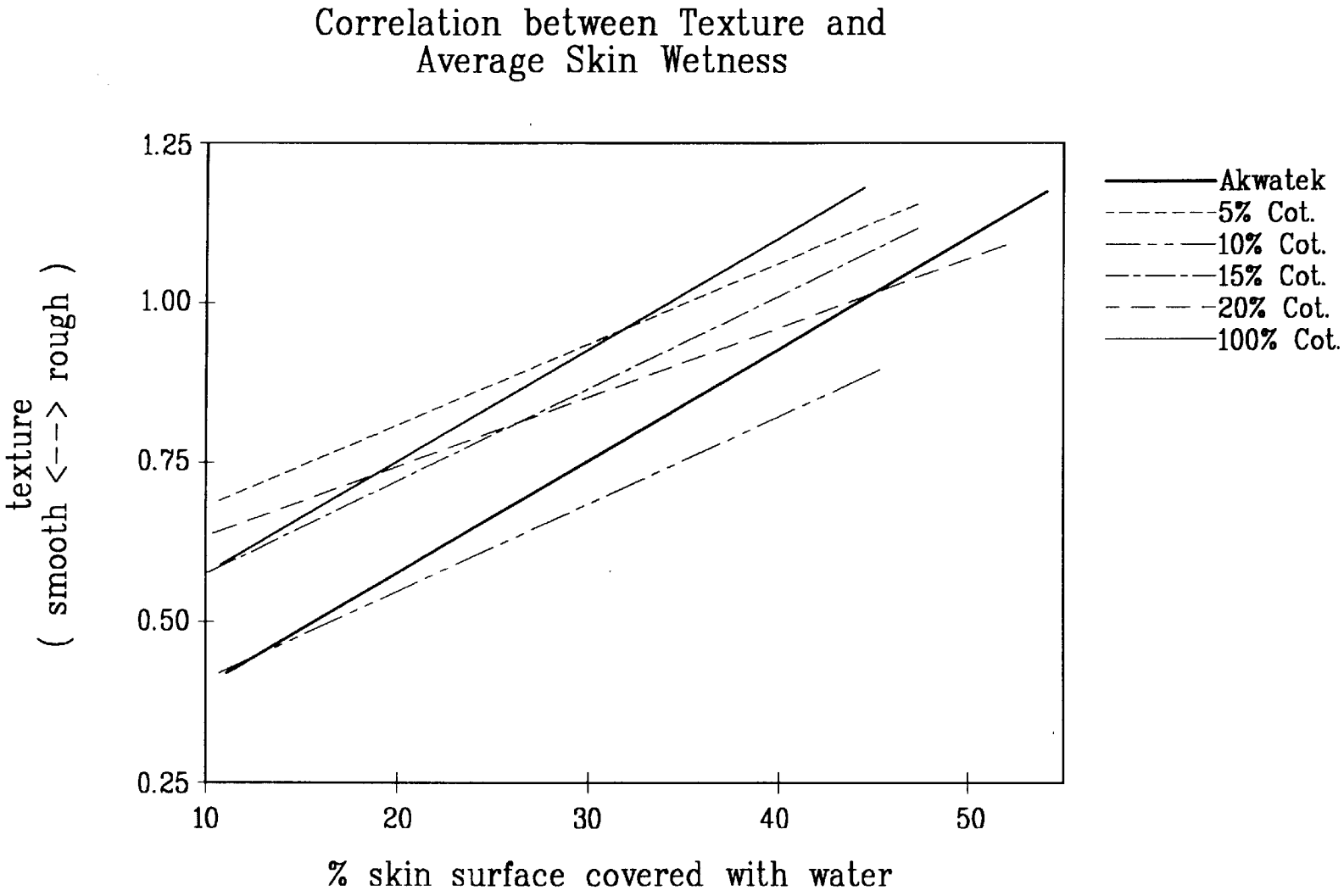
FIG. 4 is a graph showing the correlation between texture and average skin wetness.

FIG. 4 presents a correlation between texture and average skin wetness. Ratings of the fabric texture correlate well with measured and perceived skin moisture ($p<0.001$). Water on the skin from perspiration increases the friction between skin and fabric which leads to the perception that the texture is rough and unpleasant. The increase in perceived texture roughness is generally slower for the polyester/cotton blends. With increasing skin wetness the regression lines for these cotton blend garments fall below the lines of the "Akwatek"—treated polyester and the 100% cotton. The 10% cotton blend is perceived as the smoothest of all of the fabrics at all levels of wetness.

When each of the six subjects was finished testing the six garments, he was asked to indicate his preference in terms of which garment he liked the most, least, etc., on a numerical scale of 1 to 6, with the most-preferred garment being rated 1 and the least-preferred garment being rated 6. The ratings of all six test subjects, for each garment, were added; the reciprocal of that sum was multiplied by 200 to give the final rating. These overall ratings are presented in Table 3.

TABLE 3

Overall Subjective Preference

| Fabric | Rating |
|---|---|
| "Akwatek"-treated Polyester | 9 |
| 80/20 Polyester/Cotton | 9.5 |
| 85/15 Polyester/Cotton | 12 |
| 90/10 Polyester/cotton | 11 |
| 95/5 Polyester/Cotton | 9.8 |
| 100% Cotton | 7 |

Consistent with the test results presented in FIGS. 2, 3 and 4, the subjects preferred the garments made of the 85/15 and 90/10 polyester/cotton blends.

It will be apparent that many widely different embodiments of this invention may be made without departing from the spirit and scope thereof. It is therefore not intended that the invention be limited except as indicated in the following claims.

What is claimed is:

1. A spun yarn consisting essentially of about, 85 to 90 weight % of a single hydrophobic fiber component and about 10 to 15 weight % hydrophilic fiber.

2. A yarn according to claim 1 wherein said hydrophobic fiber is selected from the group consisting of polypropylene, polyethyleneterephthalate, nylon and polyacrylonitrile.

3. A yarn according to claim 1 wherein said hydrophilic fiber is a cellulosic fiber.

4. A yarn according to claim 3 wherein said hydrophilic fiber is cotton.

5. A yarn according to claim 1 wherein said hydrophobic fiber is polyethyleneterephthalate and said hydrophilic fiber is cotton.

6. A yarn consisting essentially of about 85 to 90 weight % hydrophobic fiber and about 10 to 15 weight % hydrophilic fiber wherein said yarn comprises a spun or continuous filament core of said hydrophobic fiber surrounded by a sheath of a blend of said hydrophilic and said hydrophobic fiber.

7. A yarn according to claim 1 consisting essentially of about 85 to 90 weight % polyester fiber and about 10 to 15 weight % cotton fiber.

8. A fabric prepared from the yarn of claim 1.

9. A fabric prepared from the yarn of claim 2.

10. A fabric prepared from the yarn of claim 3.

11. A fabric prepared from the yarn of claim 4.

12. A fabric prepared from the yarn of claim 5.

13. A fabric prepared from the yarn of claim 6.

14. A fabric prepared from the yarn of claim 7.

15. The fabric of claim 8 wherein about 5 to about 10% of a continuous elastomeric filament is incorporated therein.

16. A garment prepared from the fabric of claim 8.

17. A yarn according to claim 1 consisting essentially of about 85 weight % of said hydrophobic fiber component and about 15 weight % of said hydrophilic fiber.

18. A yarn according to claim 1 consisting essentially of about 90 weight % of said hydrophobic fiber component and about 10 weight % of said hydrophilic fiber.

19. A yarn according to claim 1 wherein said hydrophilic fiber is wool.

20. A yarn according to claim 17 wherein said hydrophilic fiber is wool.

21. A yarn according to claim 18 wherein said hydrophilic fiber is wool.

22. A fabric prepared from the yarn of claim 17.

23. A fabric prepared from the yarn of claim 18.

24. A fabric prepared from the yarn of claim 19.

25. A fabric prepared from the yarn of claim 20.

26. A garment prepared from the fabric of claim 12.

27. A garment prepared from the fabric of claim 15.

28. A garment prepared from the fabric of claim 22.

29. A garment prepared from the fabric of claim 23.

30. A garment prepared from the fabric of claim 24.

31. A garment prepared from the fabric of claim 25.

32. A fabric prepared from a yarn consisting essentially of about 85 to 90 weight % of a single hydrophobic fiber component and about 10 to 15 weight % hydrophilic fiber, wherein about 5 to about 10% of a continuous elastomeric filament is incorporated into said fabric.

33. A yarn consisting essentially of about 85 to 90 weight % of a single hydrophobic fiber component and about 10 to 15 weight % wool.

34. A yarn according to claim 33 consisting essentially of about 85 weight % of said hydrophobic fiber and about 15 weight % of said wool.

35. A yarn according to claim 33 consisting essentially of about 90 weight % of said hydrophobic fiber and about 10 weight % of said wool.

36. A fabric prepared from the yarn of claim 33.

37. A fabric prepared from the yarn of claim 34.

38. A garment prepared from the fabric of claim 32.

39. A garment prepared from the fabric of claim 36.

40. A garment prepared from the fabric of claim 37.

* * * * *